US006607169B1

(12) United States Patent
Gershfeld

(10) Patent No.: US 6,607,169 B1
(45) Date of Patent: Aug. 19, 2003

(54) CABLE ORGANIZER FOR ATTACHMENT TO AN EDGE OF A TABLE

(76) Inventor: Jack Gershfeld, 615 Del Rio Way, Fullerton, CA (US) 92835

( * ) Notice: Subject to any disclaimer, the term of this patent is extended or adjusted under 35 U.S.C. 154(b) by 0 days.

(21) Appl. No.: 10/138,824

(22) Filed: May 6, 2002

(51) Int. Cl.[7] ..... F16L 3/08; A47F 5/08

(52) U.S. Cl. ..... 248/65; 248/309.2; 211/87.01; 211/60.1

(58) Field of Search ..... 248/65, 68.1, 73, 248/228.6, 230.6, 231.71, 302, 229.25, 309.2, 309.1, 90, 91; 211/87.01, 57.1, 60.1, 70.6, 105.1, 106

(56) References Cited

U.S. PATENT DOCUMENTS 2,243,387 A * 5/1941 Livingston ..... 248/90
3,204,908 A * 9/1965 Brown ..... 248/228.6
3,279,720 A * 10/1966 Garrett ..... 248/228.6
4,863,020 A * 9/1989 Klemow ..... 211/60.1
4,878,586 A * 11/1989 Bancroft et al. ..... 211/106
5,020,759 A * 6/1991 Weber ..... 248/309.2
5,788,092 A * 8/1998 Teeney ..... 211/70.6
6,109,460 A * 8/2000 Herlevi et al. ..... 211/85.13
6,238,235 B1 5/2001 Shavit

* cited by examiner

*Primary Examiner*—Anita King
(74) *Attorney, Agent, or Firm*—Vladimir Khiterer

(57) ABSTRACT

This invention discloses a cable organizer for attachment to an edge of a table and organizing cables for connecting to equipment on a table top. The cable organizer has a base with a cable guide extending at a substantially ninety degree angle for receiving the cables and teeth extending a substantially forty five degree angle. Further provided is a cable retainer releasably mounted to the teeth such that the cable retainer and the teeth form cable-receiving passages for guiding the cables from the cable guide and for arranging the cables for connection to the equipment on the table top. Also provided is a clamp means fixedly attached to the base for attachment to the edge of the table.

6 Claims, 3 Drawing Sheets

CABLE ORGANIZER FOR ATTACHMENT TO AN EDGE OF A TABLE

BACKGROUND OF THE INVENTION

The present invention pertains to a cable organizer for attachment to an edge of a table and organizing a plurality of cables for connecting to equipment on a table top. More specifically, this invention is a solution to the problem of safe, efficient and neat organization of cables which accompany laptop computers, monitors, projectors, distribution amplifiers, switchers and other equipment used in a conference room setting for audio visual presentations. Very often, conference rooms, board rooms and the like are not equipped with interfaces installed in a table top or other furniture that allow easy and neat connection of various components of an audio visual presentation system. In such a case, numerous cables that interconnect various equipment often become unsightly, confusing and potentially unsafe tangles of wiring. The cable organizer of the present invention can be brought in a conference room, installed on the edge of a conference room table or other furniture and provide a more neatly and clearly organized cables for easier routing, substitution and replacement, as well as economy of space (the total number of cables crossing the table-top or other work surface is reduced, freeing that surface for use).

SUMMARY OF THE INVENTION

The cable organizer of the present invention is durable, inexpensive to manufacture and simple to assemble. The cable organizer comprises a base, a cable guide for receiving the cables disposed on a lower receiving end of the base and extending outwardly from the base at a substantially ninety degree angle, a plurality of teeth disposed on an upper terminal end of the base, the teeth extend outwardly from the base at a substantially forty five degree angle. Further, a cable retainer is releasably mounted to the teeth such that the cable retainer and the teeth form a plurality of cable-receiving passages for guiding the cables from the cable guide and for arranging the cables at the upper terminal end for connection to the equipment on the table top. Also provided is a clamp means fixedly attached to the base for attachment to the edge of the table.

BRIEF DESCRIPTION OF THE DRAWINGS FIGURES

DETAILED DESCRIPTION OF THE PREFERRED EMBODIMENT

Figure 1:
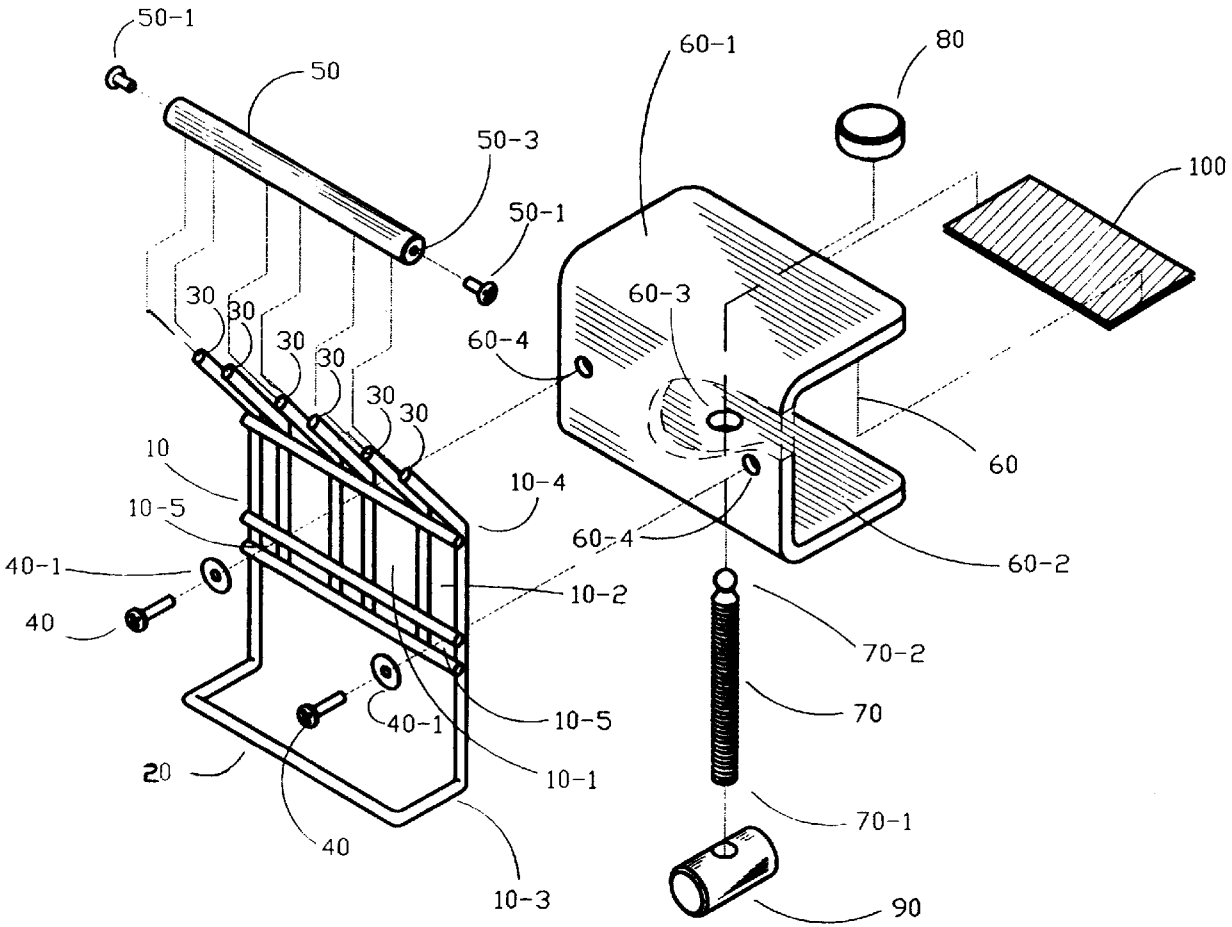
FIG. 1 shows an exploded isometric view of the cable organizer for attachment to an edge of a table according to the preferred embodiment of the present invention.
Figure 2:
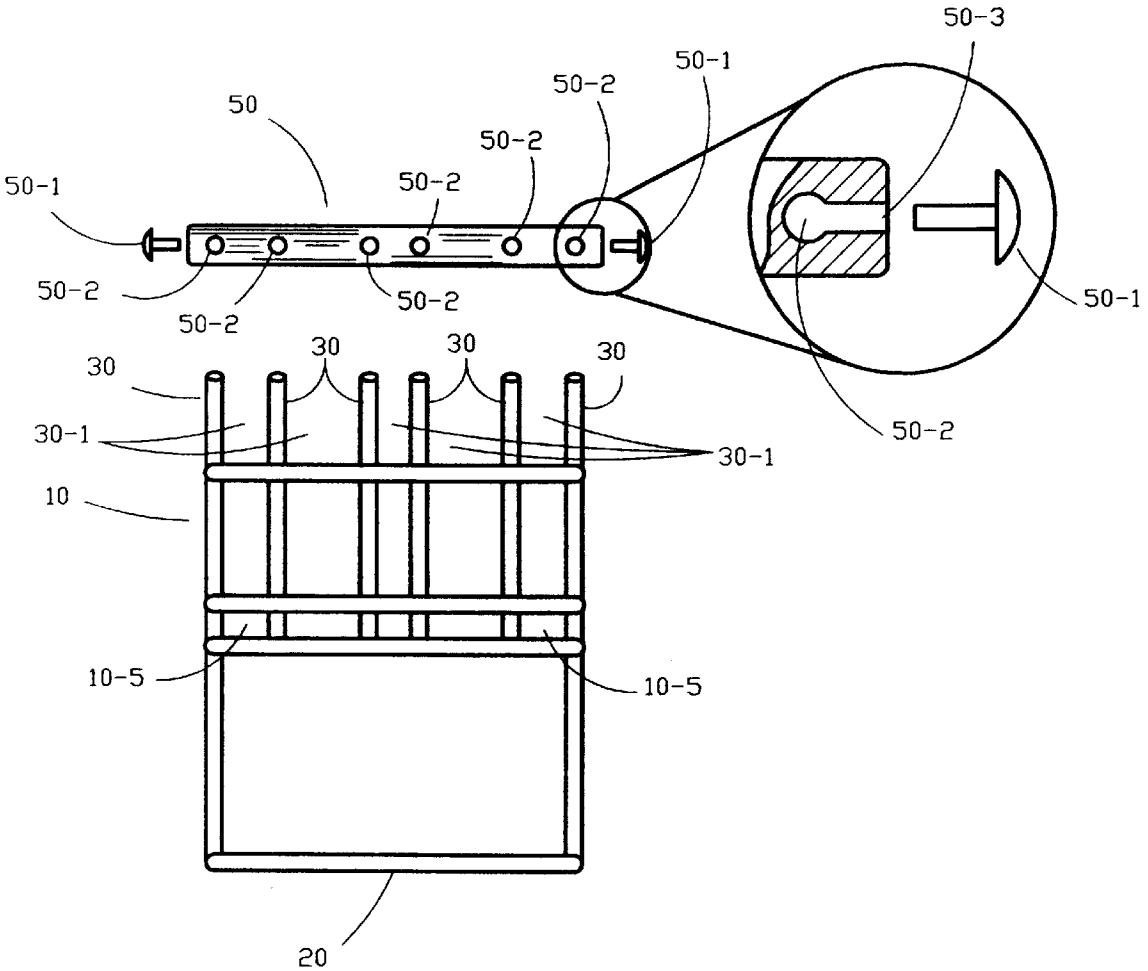
FIG. 2 shows a front elevational view of a base, as well as a bottom plan view of a cable retainer. The preferred embodiment of the present invention comprises, among other things, the base and cable retainer.
Figure 3:
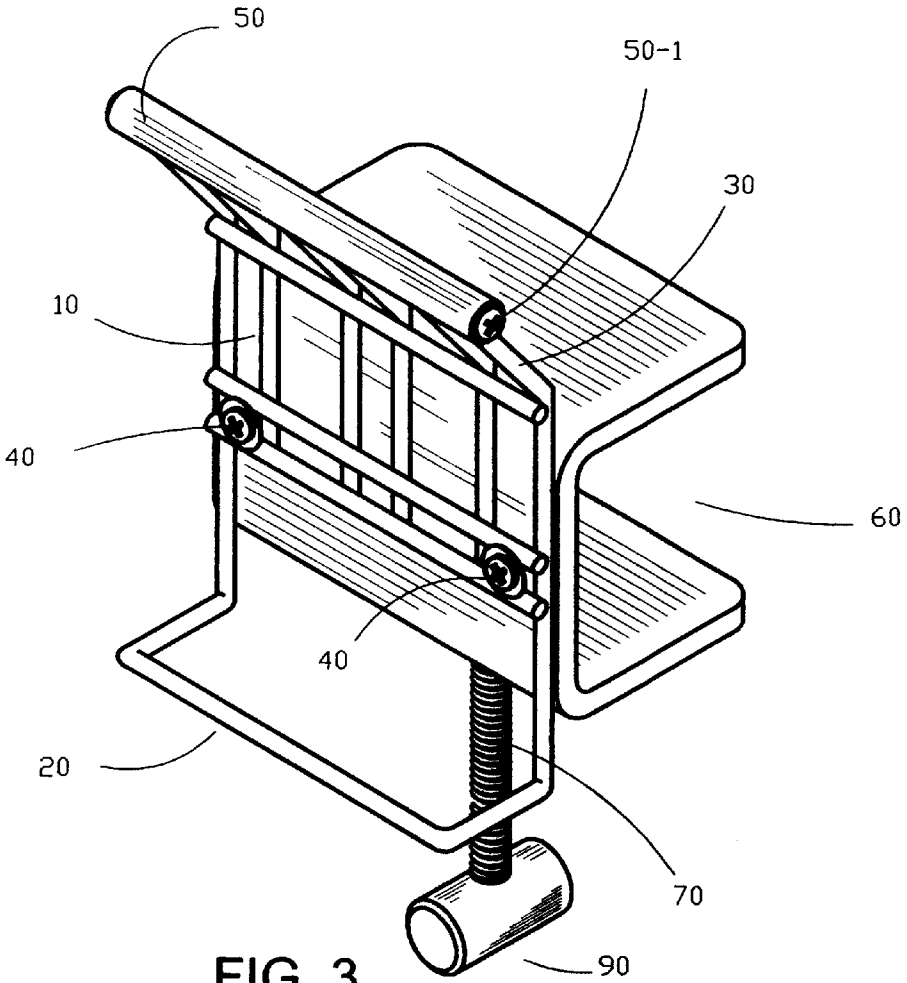
FIG. 3 shows an isometric view of the cable organizer for attachment to an edge of a table in the assembled condition, according to the preferred embodiment of the present invention.

This invention will be better understood with the reference to the drawing figures FIG. 1, FIG. 2 and FIG. 3. The same numerals refer to the same elements in all drawing figures.

Viewing FIG. 1, numeral 10 indicates a base. Base 10 comprising front surface indicated by numeral 10-1 and back surface indicated by numeral 10-2. Front Surface 10-1 and Back Surface 10-2 extend between opposite lower receiving and upper terminal ends, indicated, respectively, by numerals 10-3 and 104.

Numeral 20 indicates a cable guide. Cable Guide 20 is disposed on Lower Receiving End 10-3 and extends outwardly from Front Surface 10-1. The preferred embodiment of this invention shows Cable Guide 20 extending outwardly from Front Surface 10-1 at a substantially ninety degree angle, even though the persons knowledgeable in the pertinent arts will recognize that this angle can be different. The purpose of Cable Guide 20 is to receive a plurality of cables.

Numeral 30 indicates a plurality of teeth. Teeth 30 are disposed on Upper Terminal End 10-4 and extend outwardly from Front Surface 10-1. The preferred embodiment of this invention shows Teeth 30 extending outwardly from Front Surface 10-1 at a substantially forty five degree angle, even though the persons knowledgeable in the pertinent arts will recognize that this angle can be different.

Numeral 50 indicates a cable retainer. Cable Retainer 50 releasably mounts to Teeth 30. Specifically, viewing now FIG. 2, Cable Retainer 50 and Teeth 30 form a plurality of cable-receiving passages indicated by numerals 30-1. The purpose of Cable-Receiving Passages 30-1 is to guide there through the plurality of cables from Cable Guide 20 and to arrange the plurality of cables at Upper Terminal End 10-4 for connection to the equipment on the table top.

The preferred embodiment of this invention shows Base 10, Cable Guide 20 and Teeth 30 made of formed wire. However, as should be apparent to the persons knowledgeable in the pertinent arts, Base 10, Cable Guide 20 and Teeth 30 can be made of different materials. Further, the preferred embodiment of this invention shows Cable Retainer 50 as a substantially elongated cylindrical bar comprising a cylindrical lateral surface extending between opposite circular caps. Cable Retainer 50 according to the preferred embodiment also comprises a pair of impingement screws indicated by numerals 50-1. However, a different design for Cable Retainer 50 can be used.

Viewing now top portions of both FIG. 1 and FIG. 2, additional elements of Cable Retainer 50 according to the preferred embodiment (which can also be designed in a different fashion, if necessary) will be discussed. Numeral 50-2 indicates a plurality of openings disposed on the cylindrical lateral surface of Cable Retainer 50. The purpose of Openings 50-2 is to receive and engage with Teeth 30.

Numeral 50-3 indicates axial threaded bores. Axial Threaded Bores 50-3 are disposed in the opposite circular caps of Cable Retainer 50. The purpose of Axial Threaded Bores 50-3 is to receive and threadibly engage Impingement Screws 50-1.

Viewing now the upper right portion of FIG. 2, there is shown a partial sectional view of Cable Retainer 50. As can be seen in the partial sectional view, each of Axial Threaded Bores 50-3 connects with at least one of Openings 50-2 such that each of Impingement Screws 50-1 placed inside Axial Threaded Bores 50-3 impinges and engages by way of force of friction one of Teeth 30.

Viewing again FIG. 1, numeral 60 indicates a clamp means. Clamp Means 60 is disposed on Back Surface 10-2 and is fixedly attached to Base 10. The purpose of Clamp Means 60 is to attach to an edge of the table. Viewing now the right hand portion of FIG. 2, additional elements of Clamp Means 60 according to the preferred embodiment (which can also be designed in a different fashion, if necessary) will be discussed. Specifically, Clamp Means 60 comprises a C-shaped clamp frame having opposing upper and lower lips, indicated by numerals 60-1 and 60-2, respectively.

Numeral 70 indicates a clamp rod. Clamp Rod 70 has a threaded lateral surface extending between opposite distal and proximal ends indicated by numerals 70-1 and 70-2, respectively. Numeral 60-3 indicates a threaded hole. Threaded Hole 60-3 is disposed on Lower Lip 60-2. The purpose of Threaded Hole 60-3 is to receive and threadibly engage Clamp Rod 70.

Numeral 80 indicates a level means. Level Means 80 fixedly attaches to Proximal End 70-2. The purpose of Level Means 80 is to impingingly engage the edge of the table between Level Means 80 and said Upper Lip 60-1.

Numeral 90 indicates a knob. Knob 90 fixedly attaches to Distal End 70-1. The purpose of Knob 90 is to turn Clamp Rod 70 and thus selectively position Level Means 80.

Numeral 100 indicates a rubber strip. Rubber Strip 100 fixedly attaches to an inner surface of Upper Lip 60-1. The purpose of Rubber Strip 100 is to protect the table-top from scratching.

Numeral 40 indicates attachment screws. Clamp Means 60 and Base 10 comprise corresponding openings, indicated by numerals 604 and 10-5, respectively. The purpose of Corresponding Openings 60-4 and 10-5 is to receive Attachment Screws 40 and fixedly attach Clamp Means 60 to Base 10 by way of Attachment Screws 40. Numeral 40-1 indicates washers. The purpose of Washers is to prevent Attachment Screws 40 from passing through Corresponding Openings 10-5.

Viewing now FIG. 3, there is shown an isometric view of the cable organizer for attachment to an edge of a table in the assembled condition, according to the preferred embodiment of the present invention. Clamp Means 60 slides on the edge of the table and fixedly attaches to the edge of the table by way of turning Knob 90. Cables are received by Cable Guide 20 and placed in Cable-Receiving Passages 30-1 (i.e. between Teeth 30—Cable-Receiving Passages 30-1 are not visible in FIG. 3, they can be best viewed in FIG. 2). Cable Retainer 50 is then mounted to Teeth 30 by placing Teeth 30 inside Openings 50-2 (Openings 50-2 are also not visible in FIG. 3, they can be best viewed in FIG. 2) and tightening Impingement Screws 50-1 until they engage with Teeth 30, thus securing Cable Retainer 50 to Teeth 30.

This permits a more neatly and clearly organized cables for easier routing, substitution and replacement, as well as economy of space.

While the present invention has been described and defined by reference to the preferred embodiment of the invention, such reference does not imply a limitation on the invention, and no such limitation is to be inferred. The invention is capable of considerable modification, alteration, and equivalents in form and function, as will occur to those ordinarily skilled and knowledgeable in the pertinent arts. The depicted and described preferred embodiment of the invention is exemplary only, and is not exhaustive of the scope of the invention. Consequently, the invention is intended to be limited only by the spirit and scope of the appended claims, giving full cognizance to equivalents in all respects.

What is claimed is:

1. A cable organizer for attachment to an edge of a table and organizing a plurality of cables for connecting to equipment on a table top, comprising:

(a) a base comprising front and back surfaces extending between opposite lower receiving and upper terminal ends;

(b) a cable guide for receiving the plurality of cables, said cable guide disposed on said lower receiving end, said cable guide extending outwardly from said front surface at a first angle;

(c) a plurality of teeth disposed on said upper terminal end, said teeth extending outwardly from said front surface at a second angle;

(d) a cable retainer releasably mounted to said teeth, said cable retainer and said teeth forming a plurality of cable-receiving passages for guiding there through the plurality of cables from said cable guide and for arranging the plurality of cables at the upper terminal end for connection to the equipment on the table top;

(e) a clamp means for attachment to an edge of the table disposed on said back surface and fixedly attached to said base.

2. A cable organizer as in claim 1, wherein said first angle is substantially ninety degrees and said second angle is substantially forty five degrees.

3. A cable organizer as in claim 2, further comprising attachment screws wherein said clamp means and said base further comprise corresponding openings for receiving said attachment screws and fixedly attaching said clamp means to said base by way of said attachment screws.

4. A cable organizer as in claim 3, wherein said base, said teeth and said cable guide are made of formed wire.

5. A cable organizer as in claim 4, wherein said cable retainer comprises a substantially elongated cylindrical bar and a pair of impingement screws, said substantially elongated cylindrical bar comprising:

(a) a cylindrical lateral surface extending between opposite circular caps;

(b) a plurality of openings disposed on said cylindrical lateral surface for receiving and engaging with said plurality of teeth;

(c) axial threaded bores disposed in said opposite circular caps for receiving and threadibly engaging said impingement screws, each of said axial threaded bores connecting with at least one of said plurality of openings such that each of said impingement screws placed inside said axial threaded bore impinges and engages by way of force of friction one of said teeth.

6. A cable organizer as in claim 5, wherein said clamp means further comprises:

(a) a C-shaped clamp frame having opposing upper and lower lips;

(b) a clamp rod having a threaded lateral surface extending between opposite distal and proximal ends;

(c) a threaded hole disposed in said lower lip for receiving and threadibly engaging said clamp rod;

(d) a level means fixedly attached to said proximal end for impingingly engaging the edge of the table between said level means and said upper lip;

(e) a knob fixedly attached to said distal end for turning said clamp rod and selectively positioning said level means;

(f) a rubber strip fixedly attached to an inner surface of said upper lip for protecting the table-top from scratching.

* * * * *